US008141992B2

(12) United States Patent
Ishizawa et al.

(10) Patent No.: US 8,141,992 B2
(45) Date of Patent: Mar. 27, 2012

(54) LIQUID STORAGE CONTAINER

(75) Inventors: Taku Ishizawa, Matsumoto (JP); Satoshi Shinada, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 948 days.

(21) Appl. No.: 11/690,790

(22) Filed: Mar. 23, 2007

(65) Prior Publication Data

US 2008/0012914 A1 Jan. 17, 2008

(30) Foreign Application Priority Data

Mar. 24, 2006 (JP) ..... 2006-083051
Mar. 24, 2006 (JP) ..... 2006-083052
Aug. 12, 2006 (JP) ..... 2006-220764

(51) Int. Cl.
*B41J 2/175* (2006.01)

(52) U.S. Cl. ..... 347/85

(58) Field of Classification Search ..... 385/84–86, 385/92, 95, 97, 100; 347/84–86, 92, 95, 347/97, 100
See application file for complete search history.

(56) References Cited

U.S. PATENT DOCUMENTS 4,969,759 A 11/1990 Suzuki et al.
5,801,737 A 9/1998 Sato et al.
6,070,976 A 6/2000 Takagi et al.
6,296,354 B1 * 10/2001 Hashimoto ..... 347/87
6,450,631 B1 9/2002 Hayashi et al.
6,470,744 B1 10/2002 Usui et al.
6,550,902 B2 * 4/2003 Shinada et al. ..... 347/86
6,723,147 B2 4/2004 Mashiko et al.
6,726,315 B2 4/2004 Koizumi et al.
6,848,776 B2 * 2/2005 Nishioka et al. ..... 347/86
7,055,942 B2 * 6/2006 Amma et al. ..... 347/93
7,125,108 B2 10/2006 Toba et al.
7,147,309 B2 12/2006 Sakai et al.
7,222,949 B2 5/2007 Ichihashi et al.
7,249,832 B2 7/2007 Sakai et al.
7,300,142 B1 11/2007 Usui et al.
7,513,613 B2 * 4/2009 Ishizawa et al. ..... 347/86
7,758,175 B2 * 7/2010 Amano et al. ..... 347/86
2002/0024573 A1 * 2/2002 Hoen et al. ..... 347/92
2002/0044168 A1 4/2002 Hashi et al.
2004/0046845 A1 * 3/2004 Haan et al. ..... 347/86
2004/0174417 A1 * 9/2004 Kobayashi et al. ..... 347/85
2004/0218026 A1 * 11/2004 Matsushita et al. ..... 347/93
2004/0252146 A1 * 12/2004 Naka et al. ..... 347/6
2005/0041077 A1 2/2005 Lee (Continued)

FOREIGN PATENT DOCUMENTS

CN 1241491 A 1/2000

(Continued)

*Primary Examiner* — Charlie Peng
(74) *Attorney, Agent, or Firm* — Sughrue Mion, PLLC

(57) ABSTRACT

A liquid storage container prevents sucking of air bubbles into a liquid guide path, even when the amount of liquid remaining in the liquid storage chamber is reduced. The amount of liquid discarded, without being used, is reduced. A liquid storage container includes liquid storage chambers from which liquid is guided to a liquid-supplying unit through a liquid guide path and a liquid remaining-amount sensor for detecting the presence/absence of the liquid on the basis of variation in residual vibration that occurs when air bubbles enter the liquid guide path. The liquid storage chambers have concavities in the bottom walls thereof. Liquid outlets that communicate with the liquid guide path are formed at the bottom of the concavities, respectively. Therefore, air layers in the liquid storage chambers are prevented from coming into contact with the liquid outlets, respectively, before the remaining liquid does.

16 Claims, 9 Drawing Sheets

U.S. PATENT DOCUMENTS

| | | | | |
|---|---|---|---|---|
| 2005/0104942 | A1 | 5/2005 | Katayama et al. | |
| 2005/0243110 | A1* | 11/2005 | Takahashi et al. | 347/86 |
| 2006/0203053 | A1* | 9/2006 | Katsumura | 347/86 |

FOREIGN PATENT DOCUMENTS

| | | | |
|---|---|---|---|
| CN | 1274645 | A | 11/2000 |
| CN | 1410272 | A | 4/2003 |
| CN | 1116987 | C | 8/2003 |
| CN | 1440875 | A | 9/2003 |
| EP | 1 096 780 | A | 5/2001 |
| EP | 1 190 864 | A | 3/2002 |
| EP | 1 348 555 | A1 | 10/2003 |
| EP | 1 531 055 | A | 5/2005 |
| JP | 54-061934 | A | 5/1979 |
| JP | 10-095128 | A | 4/1998 |
| JP | 11-129492 | A | 5/1999 |
| JP | 2001-146019 | A | 5/2001 |
| JP | 2002-036580 | A | 2/2002 |
| JP | 2003-112435 | A | 4/2003 |
| JP | 2004-209847 | A | 7/2004 |
| JP | 2004-249707 | A | 9/2004 |
| JP | 2005-161634 | A | 6/2005 |

* cited by examiner

LIQUID STORAGE CONTAINER

TECHNICAL FIELD

The present invention relates to a liquid storage container having a container main body that is detachably attached to a liquid-consuming apparatus and supplying liquid contained in the container main body to the liquid-consuming apparatus.

BACKGROUND ART

An ink cartridge that contains liquid ink and an ink jet recording apparatus to which the ink cartridge is exchangeably attached are examples of the above-described liquid storage container and liquid-consuming apparatus, respectively.

The ink cartridge generally has a container main body that is detachably attached to a cartridge-receiving unit of the ink jet recording apparatus. The container main body includes an ink storage chamber that is filled with ink, an ink-supplying hole for supplying the liquid contained in the ink storage chamber to the ink jet recording apparatus, an ink guide path through which the ink storage chamber and the ink-supplying hole communicate with each other, and an atmosphere communicating path for allowing air to flow into the ink storage chamber from the outside as the ink contained in the ink storage chamber is consumed. When the ink cartridge is attached to the cartridge-receiving unit of the recording apparatus, an ink supply needle included in the cartridge-receiving unit is connected to the ink-supplying hole by being inserted therein, so that the can be supplied to a recording head included in the ink jet recording apparatus.

The recording head included in the ink jet recording apparatus controls an operation of ejecting ink drops using heat or vibration. If the ink-ejecting operation is performed when there is no more ink in the ink cartridge and no ink can be supplied, the recording head will break down. Therefore, in the ink jet recording apparatus, it is necessary to monitor the amount ink remaining in the ink cartridge so as to prevent the recording head from operating when there is no ink.

In light of the above situation, an ink cartridge has been developed which includes a liquid remaining-amount sensor that outputs a predetermined electrical signal when the amount of ink remaining in a container main body is reduced to a predetermined threshold, so that a recording head included in a recording apparatus can be prevented from operating after the ink contained in the ink cartridge runs out.

Recently, various kinds of ink cartridges have been suggested which include a liquid remaining-amount sensor having a cavity that functions as a portion of the ink guide path, a vibration plate that defines a portion of a wall surface of the cavity, and a piezoelectric element provided on the vibration plate. The liquid remaining-amount sensor detects the remaining amount of ink on the basis of variation in residual vibration obtained when the vibration plate is vibrated (see, for example, JP-A-2001-146019).

In general, in a known ink cartridge, the ink storage chamber is formed as a rectangular parallelepiped storage space having a substantially flat bottom surface. An ink outlet is formed in the broad, substantially flat bottom surface or at a position near the bottom surface so as to communicate with the ink-supplying hole via the ink guide path.

However, in the ink storage chamber having such a structure, when the amount of ink remaining in the ink storage chamber becomes small, the small amount of ink is spread over a large area in the form of a thin ink layer along the broad bottom surface. Therefore, the fluidity of the ink toward the ink outlet is reduced. Accordingly, even when the ink still remains in the ink storage chamber, an air layer, which occupies a larger space in the ink storage chamber as the ink is consumed, easily comes into contact with the ink outlet. As a result, there is a risk that large air bubbles will be sucked into the ink guide path instead of the ink. In such a case, even when the ink still remains in the ink storage chamber, the liquid remaining-amount sensor determines that the ink has run out because of the air bubbles sucked into the ink guide path. Therefore, the ink remaining in the ink storage chamber cannot be used.

As described above, there is a problem that when the amount of ink remaining in the ink storage chamber is reduced, the fluidity of the ink toward the ink outlet is reduced in the ink storage chamber and the air bubbles are sucked into the ink guide path. This problem more easily occurs when the area of the bottom surface of the ink storage chamber is increased. Therefore, there is a serious problem that as the capacity of the ink storage chamber is increased to satisfy the requirements for mass printing or the like, the amount of ink that is discarded without being used is increased.

In addition, if the remaining-amount sensor once detects the absence of ink due to the air bubbles that flow into the ink guide path and then the ink remaining in the ink storage chamber moves toward the ink guide path and flows into the ink guide path, the remaining-amount sensor detects the presence of the ink again. The detection of presence of the ink after the detection of absence thereof does not normally occur. Therefore, when this phenomenon occurs, the printer determines that the sensor is malfunctioning and stops the operation.

SUMMARY OF THE INVENTION

Accordingly, an object of the present invention is to solve the above-described problems and to provide a liquid storage container which includes a liquid remaining-amount sensor for detecting the amount of liquid remaining in a liquid storage chamber by using residual vibration, which can prevent a failure that, when the amount of liquid remaining in the liquid storage chamber is reduced, an air layer in the liquid storage chamber comes into contact with a liquid outlet and air bubbles are sucked into a liquid guide path even though the liquid still remains in the liquid storage chamber, and which thereby considerably reduces the amount of liquid remaining in the liquid storage chamber that is discarded without being used.

When the air bubbles flow into the liquid guide path, there is no liquid remaining in the liquid storage chamber. Therefore, there is no possibility that liquid remaining in the liquid storage chamber will move toward the liquid guide path and flow into the liquid guide path. Accordingly, the liquid remaining-amount sensor is prevented from detecting the presence of the liquid after detecting the absence thereof. Thus, the reliability of the liquid remaining-amount sensor can be increased.

(1) The above-described object of the present invention can be achieved by a liquid storage container that is opened to the atmosphere, that is attached to a liquid-consuming apparatus, and that includes: at least one liquid storage chamber that stores liquid; a liquid-supplying hole connected to the liquid-consuming apparatus; at least one liquid guide path for guiding the liquid contained in the liquid storage chamber to the liquid-supplying hole; an atmosphere communicating path that allows atmospheric air to flow into the liquid storage chamber from the outside as the liquid in the liquid storage chamber is consumed; and a liquid remaining-amount sensor disposed at an intermediate position of the liquid guide path and determining that the liquid in the liquid storage chamber has run out when a flow of gas into the liquid guide path is detected.

The liquid storage chamber has a bottom wall having a concavity, and a liquid outlet that communicates with the liquid guide path is provided at the bottom of the concavity.

According to the above-described structure, the liquid contained in the liquid storage chamber is collected in the concavity, which is relatively small compared to the area of the bottom wall of the liquid storage chamber. Then, the liquid is guided to the liquid guide path through the liquid outlet formed at the bottom of the concavity.

More specifically, even when the amount of liquid remaining in the liquid storage chamber is reduced, the liquid remaining in the liquid storage chamber is collected at the small concavity, so that the distance from the liquid outlet to the liquid surface is maintained large. Therefore, unlike the known structure in which the bottom wall is free from the concavity and the liquid outlet is formed directly in the broad bottom wall of the liquid storage chamber, the fluidity of the liquid toward the liquid outlet is not reduced in the liquid storage chamber.

Therefore, even when the amount of liquid remaining in the liquid storage chamber is reduced, the liquid is collected at the concavity first, and is then smoothly and quickly guided to the liquid guide path. Therefore, the failure that the air layer comes into contact with the liquid outlet in the liquid storage chamber and air bubbles are sucked into the liquid guide path even though the ink still remains in the liquid storage chamber can be prevented.

As a result, the liquid remaining-amount sensor is prevented from making a false detection that the ink has run out due to the air bubbles sucked into the liquid guide path even though the liquid still remains in the liquid storage chamber. Thus, the amount of liquid remaining in the liquid storage chamber that is discarded without being used can be considerably reduced.

When the air bubbles flow into the liquid guide path, there is no liquid remaining in the liquid storage chamber. Therefore, there is no possibility that liquid remaining in the liquid storage chamber will move toward the liquid guide path and flow into the liquid guide path. Accordingly, the liquid remaining-amount sensor is prevented from detecting the presence of the liquid after detecting the absence thereof. Thus, the reliability of the liquid remaining-amount sensor can be increased.

(2) Preferably, in the liquid storage container described in (1), the at least one liquid storage chamber includes a plurality of liquid storage chambers, the plurality of liquid storage chambers being connected to each other in series such that the liquid outlet at the bottom of the concavity of one of the storage chambers that is disposed at an upstream position communicates with a liquid inlet provided near the bottom wall of another one of the storage chambers that is disposed at a downstream position. In such a case, since a plurality of liquid storage chambers are provided, the amount of liquid that can be contained is increased and the liquid capacity of the liquid storage container can be increased accordingly.

In addition, even when the amount of liquid that can be contained is increased, the effect of suppressing the air bubbles from flowing out, which is provided by the concavity, can be obtained in multiple stages by the liquid storage chambers that are connected in series.

In addition, the liquid outlet of the liquid storage chamber at the downstream position is provided near the bottom wall of the liquid storage chamber at the downstream position. Therefore, when the liquid contained in the liquid storage chamber at the upstream position is completely consumed and the liquid contained in the liquid storage chamber at the downstream position is partially consumed, the flow path connecting the liquid storage chamber at the upstream position and the liquid storage chamber at the downstream position forms a meniscus. Since the air that enters the liquid storage chamber at the downstream position is prevented from communicating with the atmosphere due to the meniscus, natural ventilation does not occur. Therefore, the liquid remaining in the liquid storage chamber at the downstream position can be prevented from being evaporated.

(3) Preferably, the liquid storage container described in (1) further includes a rib or a groove for collecting the liquid contained in the liquid storage chamber by a capillary force, the rib or the groove being disposed near the liquid outlet of the liquid storage chamber.

In such a case, the liquid remaining in a region around the bottom surface of the liquid storage chamber is not only collected at the concavity due to the gravitational force but also collected at the liquid outlet by the capillary force. Therefore, the amount of liquid that remains in the liquid storage chamber without being used and that is discarded can be further reduced.

(4) In addition, preferably, in the liquid storage container described in (1), the at least one liquid storage chamber includes two or more liquid storage chambers, one of the storage chambers that is disposed at an upstream position is at an upper position in the direction of gravity and another one of the storage chambers that is disposed at a downstream position is at a lower position in the direction of gravity, and the storage chambers are connected to each other in series by a connecting flow path, the liquid flowing downward in the direction of gravity in the connecting flow path.

In such a case, even when a plurality of liquid storage chambers are provided to, for example, increase the amount of liquid that can be contained, the amount of liquid that remains at the bottom surface of each liquid storage chamber can be reduced. In addition, the liquid in the connecting flow path is quickly guided to the liquid chamber at the downstream position due to the gravitational force, the liquid in the connecting flow path is prevented from remaining therein without being used. Therefore, the amount of liquid that remains in the liquid storage chamber without being used and that is discarded can be reduced.

The above-described object of the present invention can also be achieved by a liquid storage container that is opened to the atmosphere, that is attached to a liquid-consuming apparatus, and that includes: at least one liquid storage chamber that stores liquid; a liquid-supplying hole connected to the liquid-consuming apparatus; at least one liquid guide path for guiding the liquid contained in the liquid storage chamber to the liquid-supplying hole; an atmosphere communicating path that allows atmospheric air to flow into the liquid storage chamber from the outside as the liquid in the liquid storage chamber is consumed; and a liquid sensor disposed in the liquid guide path.

The liquid storage chamber has a bottom wall having a concavity, and a liquid outlet that communicates with the liquid guide path is provided at the bottom of the concavity.

According to the above-described structure, the liquid contained in the liquid storage chamber is collected in the concavity, which is relatively small compared to the area of the bottom wall of the liquid storage chamber. Then, the liquid is guided to the liquid guide path through the liquid outlet formed at the bottom of the concavity.

More specifically, even when the amount of liquid remaining in the liquid storage chamber is reduced, the liquid remaining in the liquid storage chamber is collected at the small concavity, so that the distance from the liquid outlet to the liquid surface is maintained large. Therefore, unlike the known structure in which the bottom wall is free from the concavity and the liquid outlet is formed directly in the broad bottom wall of the liquid storage chamber, the fluidity of the liquid toward the liquid outlet is not reduced in the liquid storage chamber.

Therefore, even when the amount of liquid remaining in the liquid storage chamber is reduced, the liquid is collected at the concavity first, and is then smoothly and quickly guided to the liquid guide path. Therefore, the failure that the air layer comes into contact with the liquid outlet in the liquid storage chamber and air bubbles are sucked into the liquid guide path even though the ink still remains in the liquid storage chamber can be prevented.

As a result, the liquid remaining-amount sensor is prevented from making a false detection that the ink has run out due to the air bubbles sucked into the liquid guide path even though the liquid still remains in the liquid storage chamber. Thus, the amount of liquid remaining in the liquid storage chamber that is discarded without being used can be considerably reduced.

When the air bubbles flow into the liquid guide path, there is no liquid remaining in the liquid storage chamber. Therefore, there is no possibility that liquid remaining in the liquid storage chamber will move toward the liquid guide path and flow into the liquid guide path. Accordingly, the liquid remaining-amount sensor is prevented from detecting the presence of the liquid after detecting the absence thereof. Thus, the reliability of the liquid remaining-amount sensor can be increased.

Detailed description of the invention A liquid storage container according to a preferred embodiment of the present invention will be described in detail below with reference to the drawings.

In the embodiment described below, an ink cartridge attached to an inkjet recording apparatus (printer), which is an example of a liquid ejection apparatus, will be explained as an example of a liquid storage container.

Figure 1:
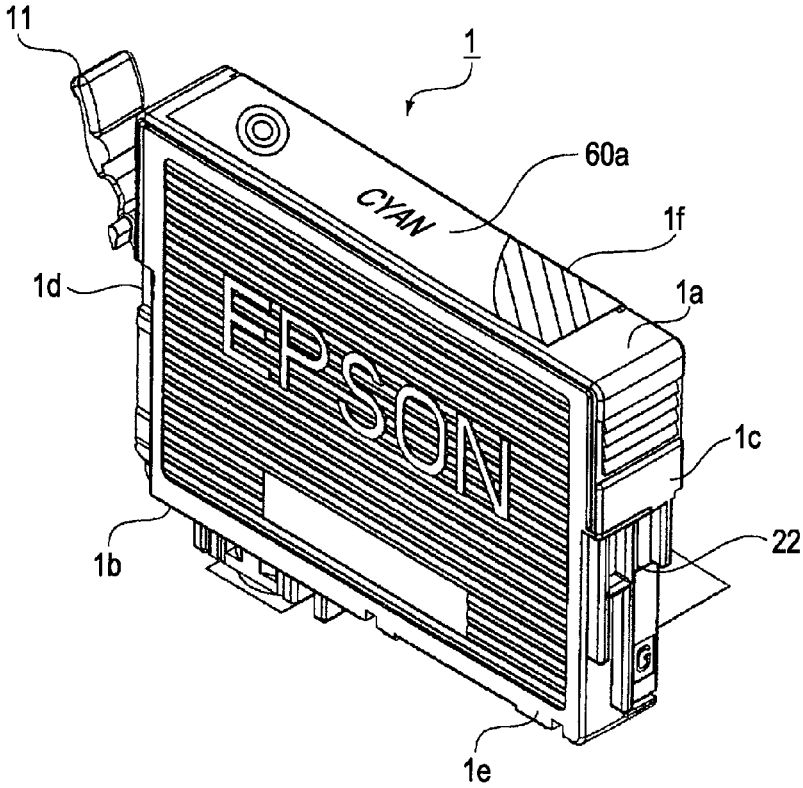
FIG. 1 is an external perspective view illustrating an ink cartridge as a liquid storage container according to an embodiment of the present invention.
Figure 2:
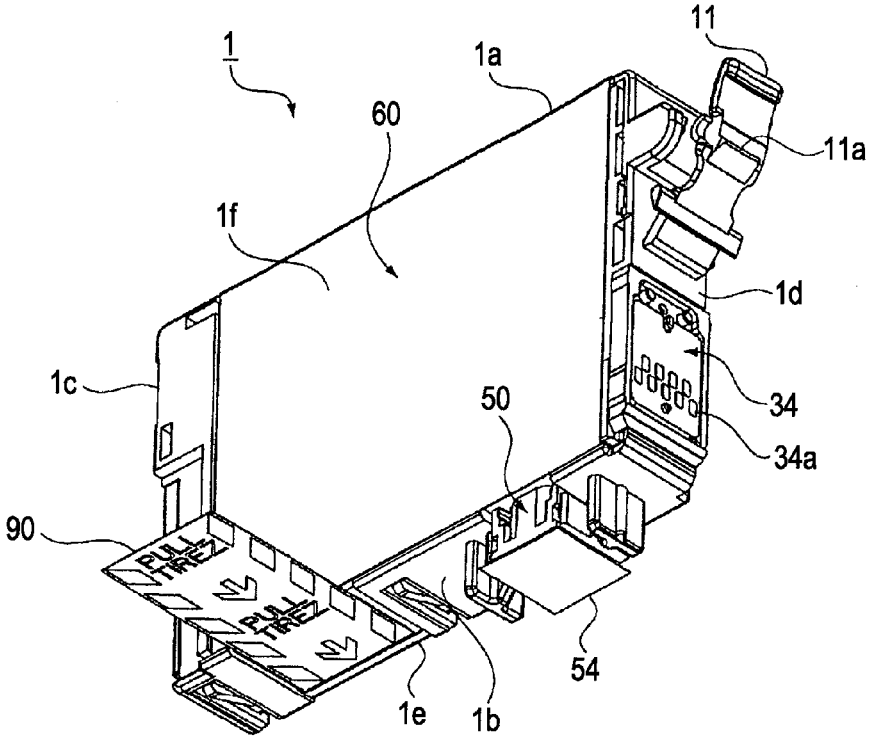
FIG. 2 is an external perspective view of the ink cartridge according to the embodiment of the present invention shown in FIG. 1 as viewed from the opposite angle.
Figure 3:
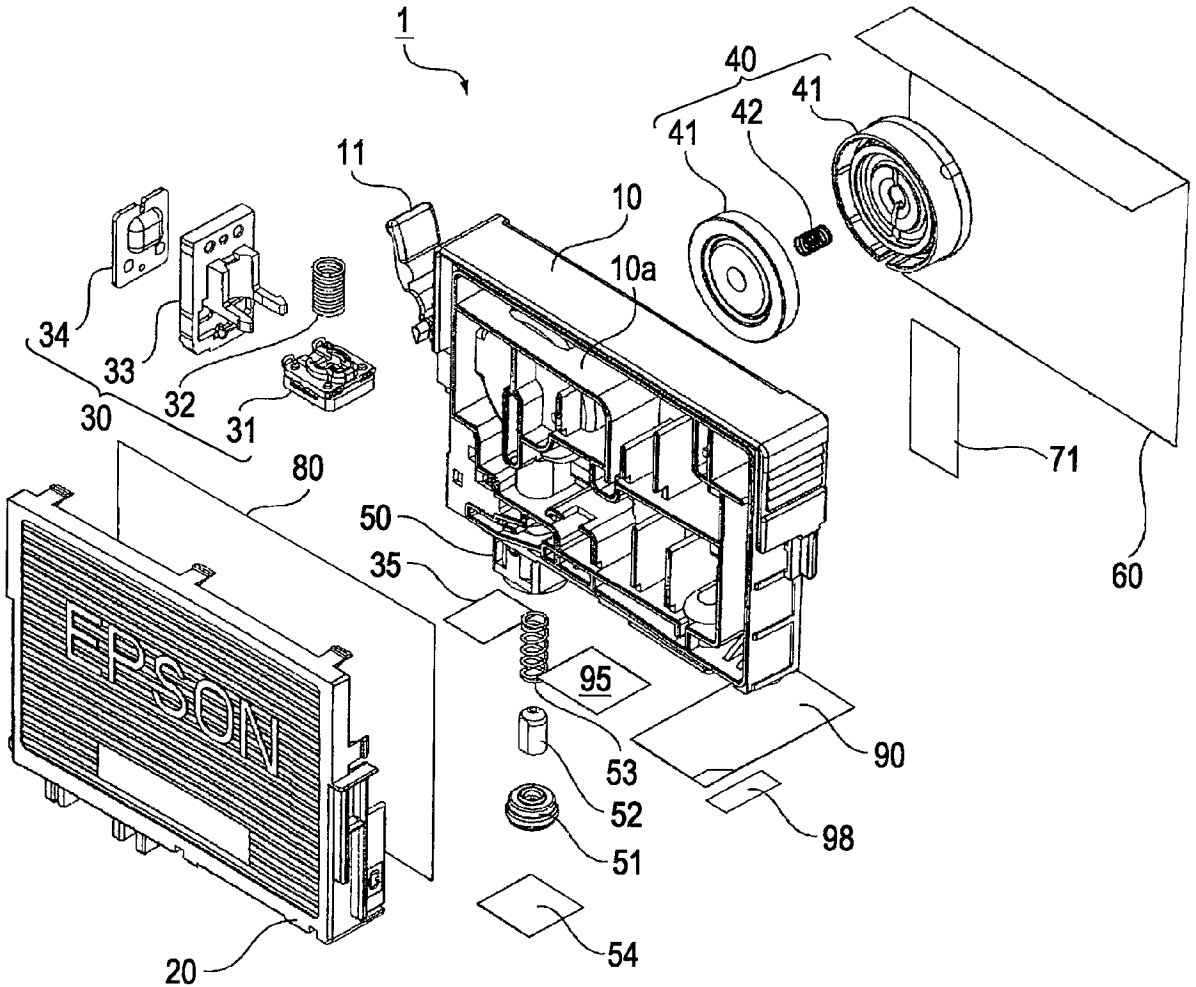
FIG. 3 is an exploded perspective view of the ink cartridge according to the embodiment of the present invention.
Figure 4:
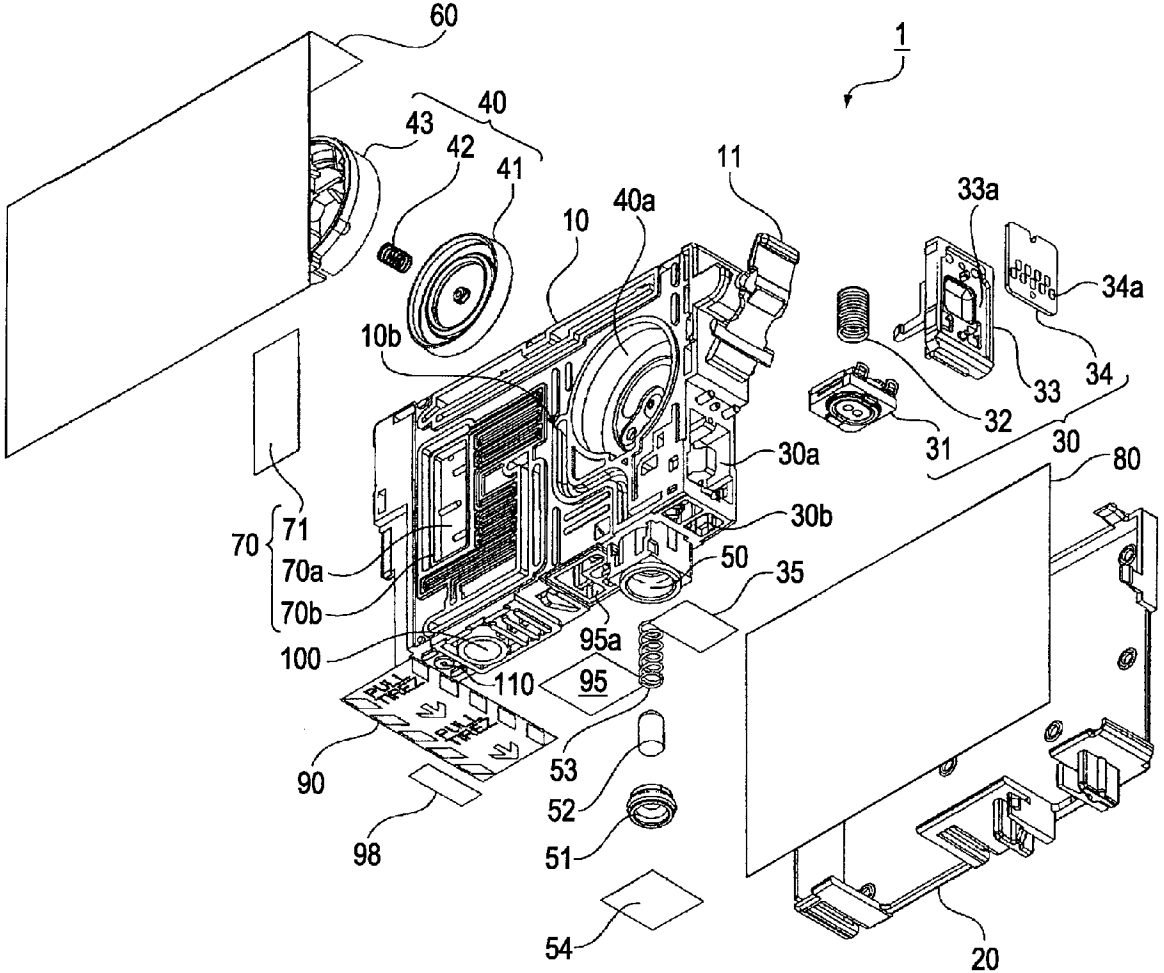
FIG. 4 is an exploded perspective view of the ink cartridge according to the embodiment of the present invention shown in FIG. 3 as viewed from the opposite angle.
Figure 5:
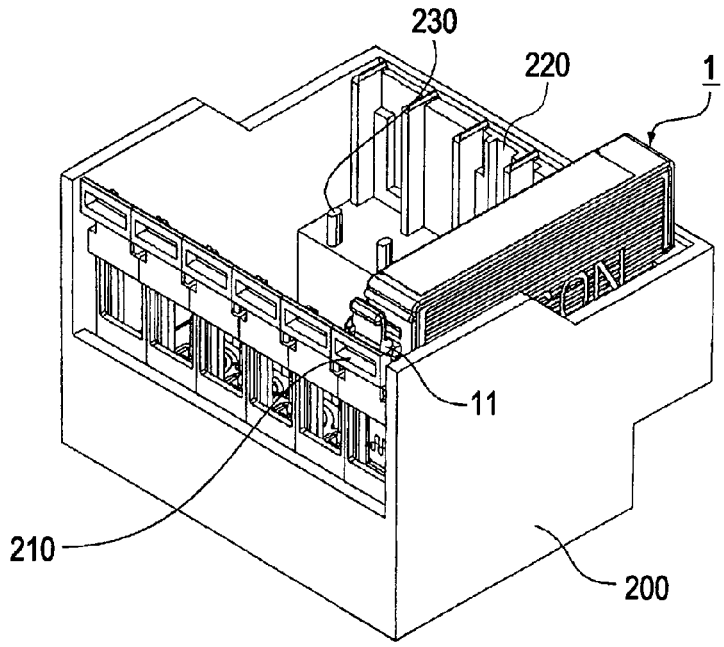
FIG. 5 is a diagram illustrating the state in which the ink cartridge according to the embodiment of the present invention is attached to a carriage of an inkjet recording apparatus.
Figure 6:
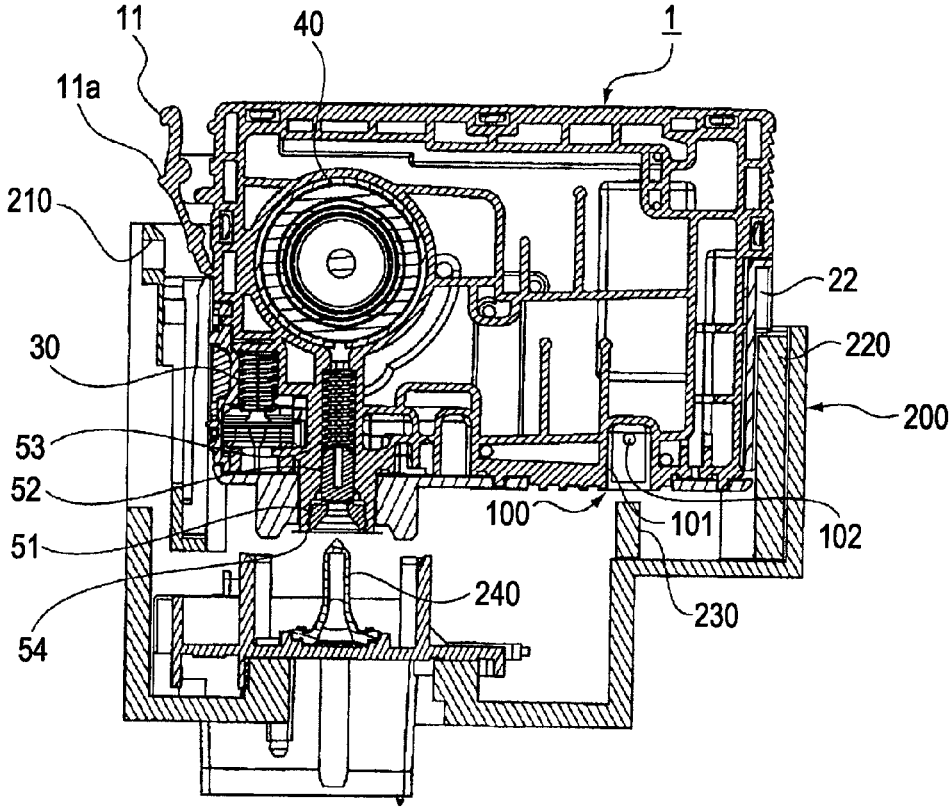
FIG. 6 is a sectional view illustrating the state immediately before the ink cartridge according to the embodiment of the present invention is attached to the carriage.
Figure 7:
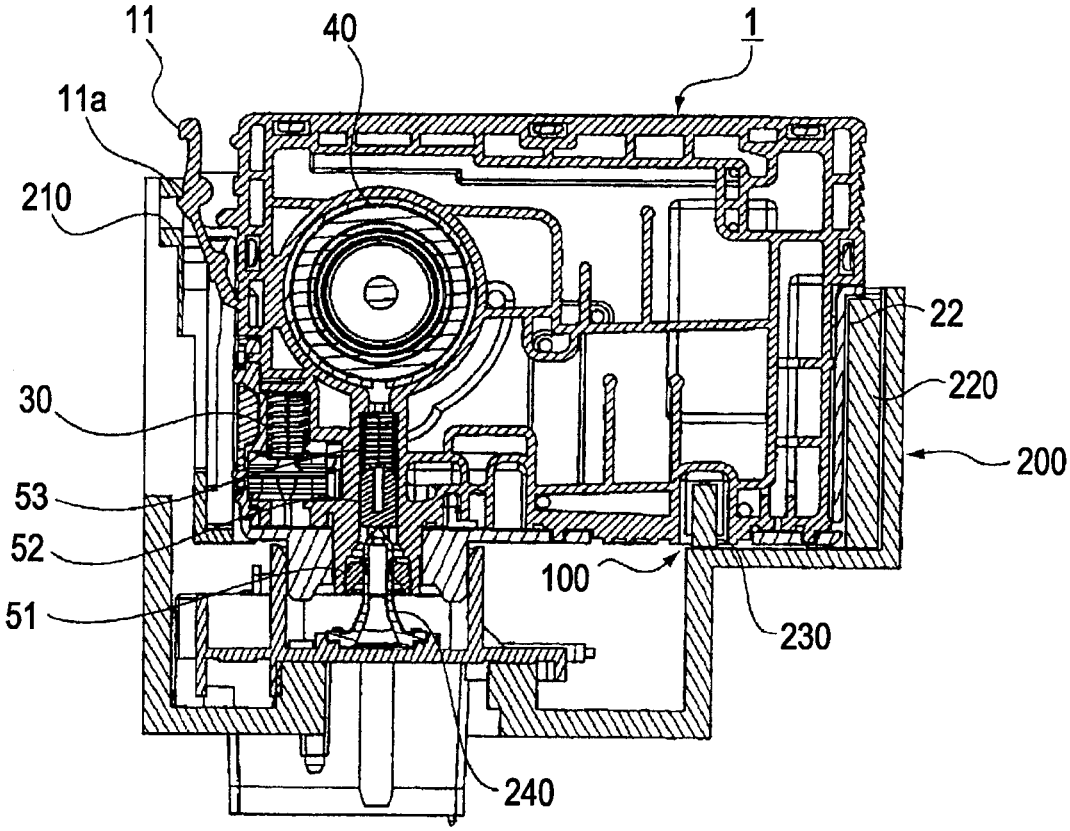
FIG. 7 is a sectional view illustrating the state immediately before the ink cartridge according to the embodiment of the present invention is attached to the carriage.

FIG. 1 is an external perspective view illustrating an ink cartridge as a liquid storage container according to an embodiment of the present invention. FIG. 2 is an external perspective view of the ink cartridge according to the present embodiment shown in FIG. 1 as viewed from the opposite angle. FIG. 3 is an exploded perspective view of the ink cartridge according to the present embodiment. FIG. 4 is an exploded perspective view of the ink cartridge according to the present embodiment shown in FIG. 3 as viewed from the opposite angle. FIG. 5 is a diagram illustrating the state in which the ink cartridge according to the present embodiment is attached to a carriage. FIG. 6 is a sectional view illustrating the state immediately before the attachment to the carriage. FIG. 7 is a sectional view illustrating the state immediately after the attachment to the carriage.

As shown in FIGS. 1 and 2, an ink cartridge 1 according to the present embodiment has a substantially rectangular parallelepiped shape, and functions as a liquid storage container that contains and stores ink in ink storage chambers provided therein. The ink cartridge 1 is attached to a carriage 200 included in an ink jet recording apparatus, which is an example of a liquid-consuming apparatus, and supplies the ink to the ink jet recording apparatus (see FIG. 5).

Characteristics of the ink cartridge 1 in appearance will be described below. As shown in FIGS. 1 and 2, the ink cartridge 1 has a flat top face 1*a* and a bottom face 1*b* that faces the top face 1*a*. An ink-supplying unit 50 that is connected to the ink jet recording apparatus and supplies ink thereto is provided at the bottom face 1*b*. An atmospheric vent 100 (see FIG. 6) for allowing atmospheric air to flow into the ink cartridge 1 is formed in the bottom face 1*b*. Thus, the ink cartridge 1 is opened to the atmosphere and supplies ink through the ink-supplying unit 50 while allowing atmospheric air to flow therein through the atmospheric vent 100.

In the present embodiment, as shown in FIG. 6, the atmospheric vent 100 is defined by a substantially cylindrical recess 101 that extends from the bottom face 1*b* toward the top face and a small hole 102 formed in the inner peripheral surface of the recess 101. The small hole 102 communicates with an atmosphere communicating path, which will be described below, and the atmospheric air flows through the small hole 102 into an ink storage chamber 370 disposed at the uppermost stream position, which will also be described below.

The depth of the recess 101 of the atmospheric vent 100 is set such that a projection 230 formed on the carriage 200 can be received by the recess 101. The projection 230 functions a removal-failure-preventing projection for preventing a sealing film 90, which functions as sealing means for sealing the atmospheric vent 100 airtight, from being left unremoved. That is, while the sealing film 90 is adhered so as to cover the atmospheric vent 100, the projection 230 cannot be inserted into the atmospheric vent 100, and therefore the ink cartridge 1 cannot be attached to the carriage 200. Since a user cannot attach the ink cartridge 1 to the carriage 200 as long as the sealing film 90 is adhered so as to cover the atmospheric vent 100, the user can be prompted to remove the sealing film 90 without failure before attaching the ink cartridge 1.

In addition, as shown in FIG. 1, a misinsertion preventing projection 22 for preventing the ink cartridge 1 from being attached at a wrong position is provided at a narrow face 1*c* adjacent to one of the short sides of the top face 1*a* of the ink cartridge 1. As shown in FIG. 5, the carriage 200, which receives the ink cartridge 1, has a recessed pattern 220 that corresponds to the misinsertion preventing projection 22. The ink cartridge 1 can be attached to the carriage 200 only when the misinsertion preventing projection 22 and the recessed pattern 220 do not interfere with each other. The shape of the misinsertion preventing projection 22 is determined in accordance with the kind of the ink, and so is the shape of the recessed pattern 220 in the carriage 200 that receives the ink cartridge 1. Therefore, even when the carriage 200 is capable of receiving a plurality of kinds of ink cartridges, as shown in FIG. 5, the ink cartridges can be prevented from being attached at wrong positions.

In addition, as shown in FIG. 2, an engagement lever 11 is provided on a narrow face 1*d* that faces the narrow face 1*c* of the ink cartridge 1. The engagement lever 11 has a projection 11*a* that engages with a recess 210 formed in the carriage 200 when the ink cartridge 1 is attached to the carriage 200. The engagement lever 11 is bent and thereby allows the projection 11*a* to engage with the recess 210, so that the ink cartridge 1 can be positioned and attached to the carriage 200.

A circuit substrate 34 is provided below the engagement lever 11. A plurality of electrode terminals 34*a* are formed on the circuit substrate 34. The electrode terminals 34*a* come into contact with electrode members (not shown) provided on the carriage 200. Accordingly, the ink cartridge 1 is electrically connected to the ink jet recording apparatus. The circuit substrate 34 has a nonvolatile memory in which data can be rewritten and which stores various information regarding the ink cartridge 1, ink usage information of the ink jet recording apparatus, etc. A liquid remaining-amount sensor (sensor unit) 31 (see FIG. 3 or FIG. 4) for detecting the amount of ink remaining in the ink cartridge 1 by utilizing residual vibration is provided behind the circuit substrate 34. In the following description, the unit including the liquid remaining-amount sensor 31 and the circuit substrate 34 is sometimes called an ink end sensor 30.

As shown in FIG. 1, a label 60*a* indicating the content of the ink cartridge is adhered to the top face 1*a* of the ink cartridge 1. The label 60*a* is formed as an end portion of an outer surface film 60 that extends so as to cover both a broad face 1*f* and the top face 1*a*.

As shown in FIGS. 1 and 2, broad faces 1*e* and 1*f* that are respectively adjacent to the two long sides of the top face 1*a* of the ink cartridge 1 are both flat. In the following description, for convenience of explanation, the broad face 1*e*, the broad face 1*f*, the narrow face 1*c*, and the narrow face 1*d* will be called front, back, right, and left sides, respectively.

Next, each component of the ink cartridge 1 will be described below with reference to FIGS. 3 and 4.

The ink cartridge 1 includes a cartridge main body 10 that functions as a container main body and a lid member 20 that covers the front side of the cartridge main body 10.

The cartridge main body 10 includes ribs 10*a* having various shapes on the front side thereof. The ribs 10*a* function as partition walls for dividing the inner space into a plurality of ink storage chambers (liquid storage chambers) that are filled with ink, an ink-free chamber that is free from the ink, and air chambers disposed at intermediate positions of an atmosphere communicating path 150, which will be described below.

A film 80 that covers the front side of the cartridge main body 10 is disposed between the cartridge main body 10 and the lid member 20. The film 80 seals the top sides of the ribs, recesses, and grooves so as to define a plurality of flow paths, the ink storage chambers, the ink-free chamber, and the air chambers.

A differential-pressure-regulating-valve storage chamber 40*a*, which functions as a recess for receiving a differential pressure regulating valve 40, and a gas-liquid separation chamber 70*a*, which functions as a recess for receiving a gas-liquid separation filter 70, are formed at the back side of the cartridge main body 10.

The differential-pressure-regulating-valve storage chamber 40*a* receive the differential pressure regulating valve 40 which includes a valve member 41, a spring 42, and a spring washer 43. The differential pressure regulating valve 40 is positioned between the ink-supplying unit 50 disposed at a downstream position and the ink storage chambers disposed at upstream positions. The differential pressure regulating valve 40 reduces a downstream pressure relative to an upstream pressure, so that the ink supplied to the ink-supplying unit 50 has a negative pressure.

A bank 70*b* is provided at a central region of the gas-liquid separation chamber 70*a* so as to extend along the outer periphery thereof, and a gas-liquid separation film 71 is adhered to the top side of the gas-liquid separation chamber 70*a* along the bank 70*b*. The gas-liquid separation film 71 blocks liquid while allowing gas to pass therethrough, and the overall structure functions as the gas-liquid separation filter 70. The gas-liquid separation filter 70 is disposed in the atmosphere communicating path 150 that connects the atmospheric vent 100 to the ink storage chambers and prevents the ink in the ink storage chambers from flowing backward through the atmosphere communicating path 150 and out of the atmospheric vent 100.

In addition to the differential-pressure-regulating-valve storage chamber 40*a* and the gas-liquid separation chamber 70*a*, a plurality of grooves 10*b* are formed in the back side of the cartridge main body 10. The outer surface film 60 covers the grooves 10*b* in a state such that the differential pressure regulating valve 40 and the gas-liquid separation filter 70 are installed. Accordingly, the open sides of the grooves 10*b* are closed so as to form the atmosphere communicating path 150 and ink guide paths.

As shown in FIG. 4, a sensor chamber 30*a* which functions as a recess for receiving members included in the ink end sensor 30 is formed in the right side of the cartridge main body 10. The sensor chamber 30*a* receives the liquid remaining-amount sensor 31 and a compression spring 32 that fixes the liquid remaining-amount sensor 31 by pressing the liquid remaining-amount sensor 31 against an inner wall of the sensor chamber 30*a*. The open side of the sensor chamber 30*a* is covered with a cover member 33, and the circuit substrate 34 is fixed to an outer surface 33*a* of the cover member 33. Sensing elements included in the liquid remaining-amount sensor 31 are connected to the circuit substrate 34.

The liquid remaining-amount sensor 31 includes a cavity that functions as a portion of an ink guide path extending between the ink-supplying unit 50 and the ink storage chambers, a vibration plate that defines a portion of a wall surface of the cavity, and a piezoelectric element (piezoelectric actuator) for causing the vibration plate to vibrate. The liquid remaining-amount sensor 31 detects the presence/absence of the ink in the ink guide path on the basis of residual vibration obtained when the vibration plate is vibrated. The liquid remaining-amount sensor 31 detects a difference in the amplitude, frequency, etc., of the residual vibration between the ink and gas, thereby determining the presence/absence of the ink in the cartridge main body 10.

More specifically, when the ink contained in the ink storage chambers of the cartridge main body 10 runs out and the atmospheric air that flows into the ink storage chambers travels through the ink guide path and enters the cavity of the liquid remaining-amount sensor 31, such a state is detected from a change in the amplitude or the frequency of the residual vibration. Accordingly, an electrical signal indicating that the ink has run out is output.

In addition to the above-described ink-supplying unit 50 and the atmospheric vent 100, as shown in FIG. 4, a pressure reducing hole 110, a recess 95*a*, and a buffer chamber 30*b* are formed in the bottom side of the cartridge main body 10. The pressure reducing hole 110 is used for reducing the pressure by sucking out the air from the ink cartridge 1 using vacuuming means when the ink is injected. The recess 95*a* defines the ink guide path that extends from the ink storage chambers to the ink-supplying unit 50. The buffer chamber 30*b* is disposed under the ink end sensor 30.

Open sides of the ink-supplying unit 50, the atmospheric vent 100, the pressure reducing hole 110, the recess 95*a*, and the buffer chamber 30*b* are sealed by sealing films 54, 90, 98, 95, and 35, respectively, immediately after the ink cartridge is manufactured. The sealing film 90 that seals the atmospheric vent 100 is removed by the user when the ink cartridge is attached to the ink jet recording apparatus for use. Accordingly, the atmospheric vent 100 is exposed and the ink storage chambers in the ink cartridge 1 communicate with the atmosphere via the atmosphere communicating path 150.

As shown in FIGS. 6 and 7, when the ink cartridge is attached to the ink jet recording apparatus, an ink supply needle 240 provided in the ink jet recording apparatus breaks the sealing film 35 adhered to the outer surface of the ink-supplying unit 50.

As shown in FIGS. 6 and 7, the ink-supplying unit 50 includes an annular seal member 51 that is pressed against the outer surface of the ink supply needle 240 when the ink cartridge is attached, a spring washer 52 that is in contact with the seal member 51 so as to close the ink-supplying unit 50 while the ink cartridge is not attached to the printer, and a compression spring 53 for urging the spring washer 52 toward the seal member 51.

As shown in FIGS. 6 and 7, when the ink supply needle 240 is inserted into the ink-supplying unit 50, the space between the inner periphery of the seal member 51 and the outer periphery of the ink supply needle 240 are sealed so that the gap between the ink-supplying unit 50 and the ink supply needle 240 are sealed liquid-tight. In addition, a tip portion of the ink supply needle 51 comes into contact with the spring washer 52 and pushes the spring washer 52 upward, so that the spring washer 52 is removed from the seal member 51. Accordingly, the ink can be supplied from the ink-supplying unit 50 to the ink supply needle 240.

The inner structure of the ink cartridge 1 according to the present embodiment will be described below with reference to FIGS. 8 to 12.

Figure 8:
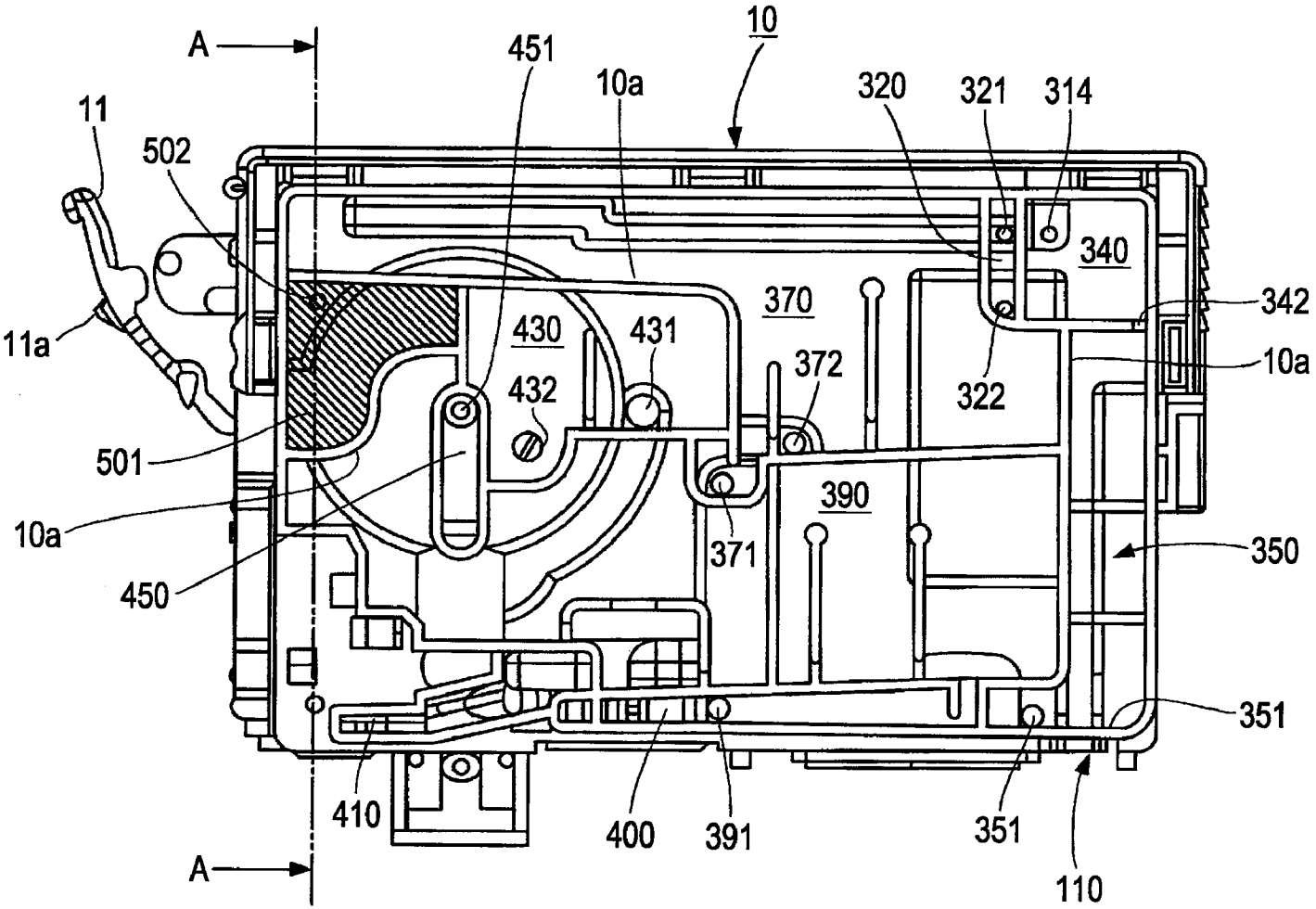
FIG. 8 is a front view of a cartridge main body of the ink cartridge according to the embodiment of the present invention.
Figure 9:
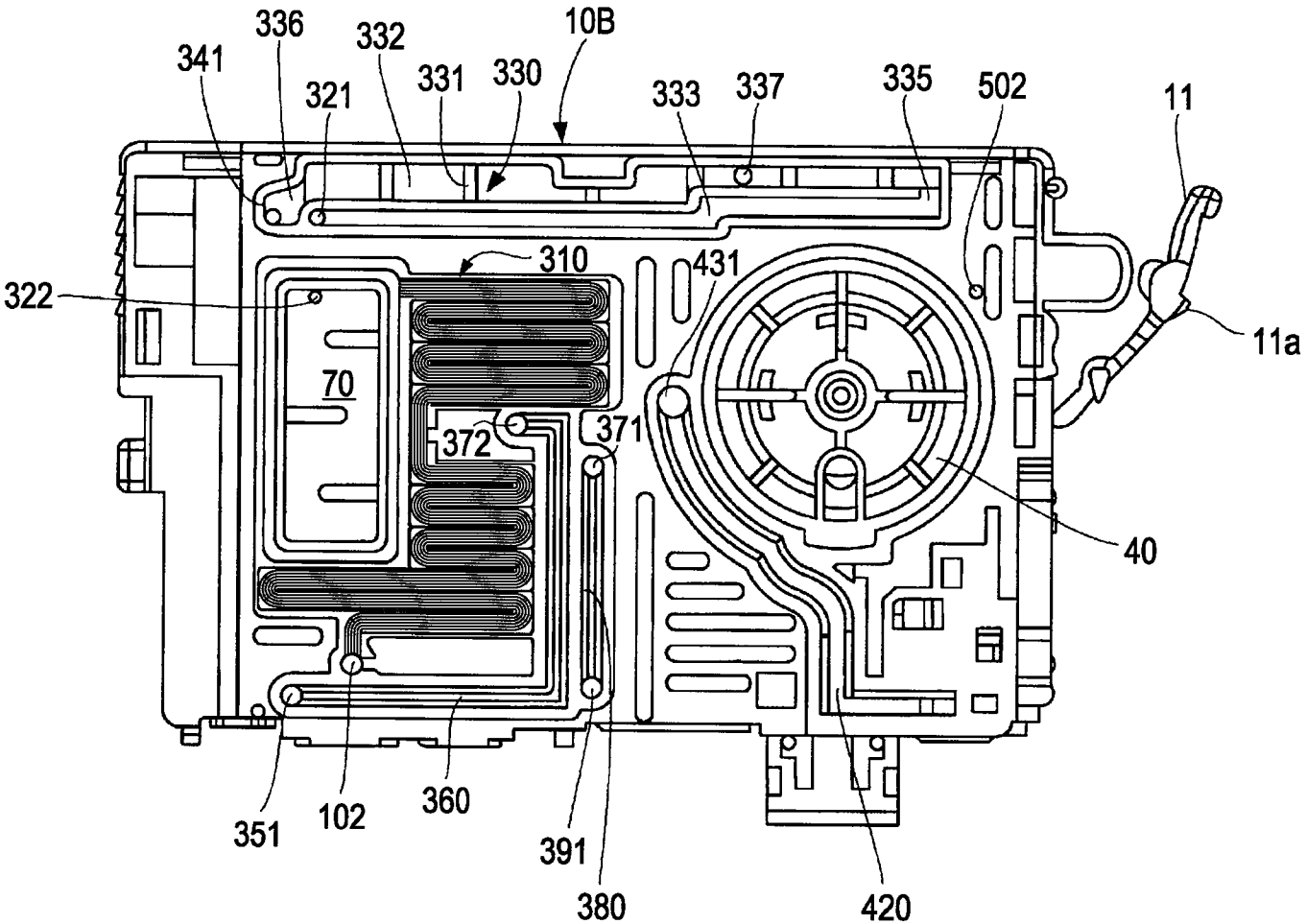
FIG. 9 is a rear view of a cartridge main body of the ink cartridge according to the embodiment of the present invention.
Figure 10:
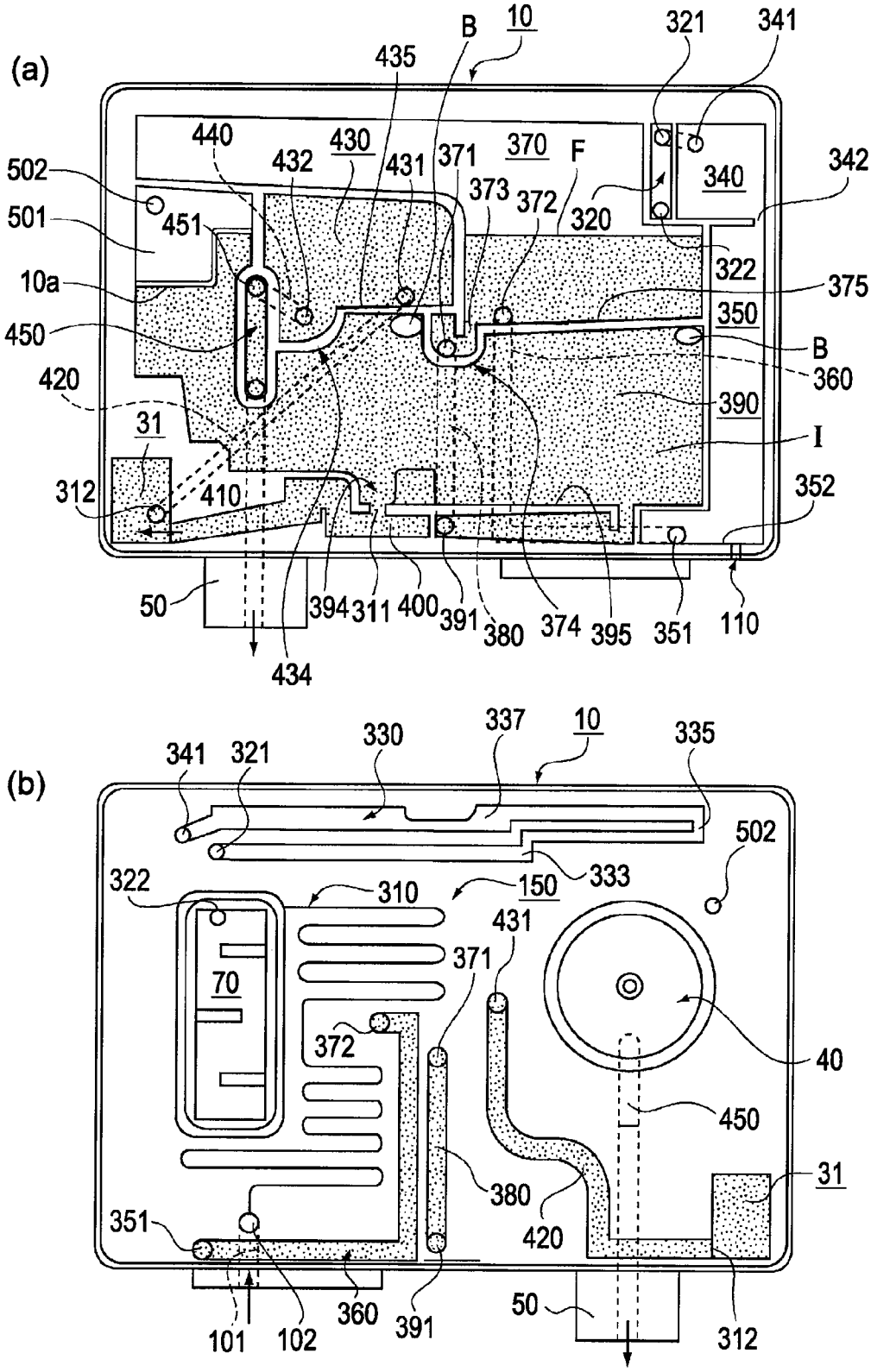
FIG. 10(*a*) is a simplified diagram of the structure shown in FIG. 8, and FIG. 10(*b*) is a simplified diagram of the structure shown in FIG. 9.
Figure 11:
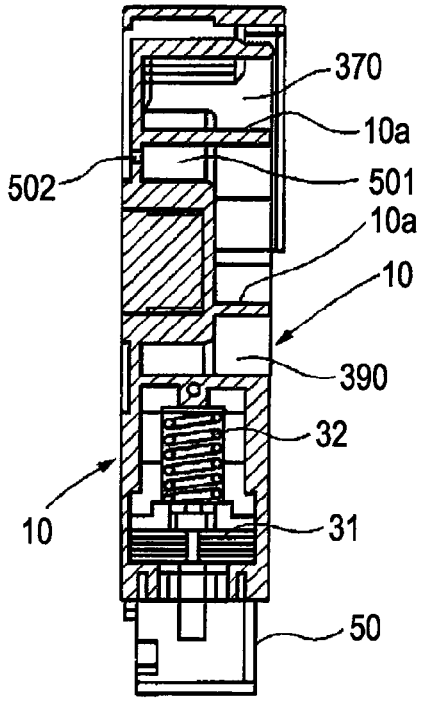
FIG. 11 is a sectional view of FIG. 8 taken along line A-A.
Figure 12:
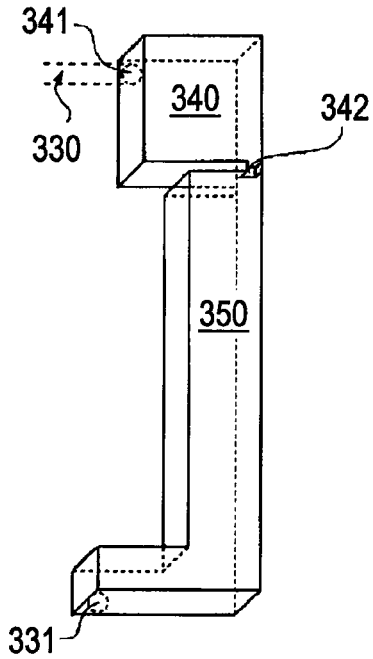
FIG. 12 is an enlarged perspective view of a portion of a flow path structure in the cartridge main body shown in FIG. 8.

FIG. 8 is a front view of the cartridge main body 10 of the ink cartridge 1 according to the present embodiment. FIG. 9 is a rear view of the cartridge main body 10 of the ink cartridge 1 according to the present embodiment. FIG. 10(*a*) is a simplified diagram of the structure shown in FIG. 8, and FIG. 10(*b*) is a simplified diagram of the structure shown in FIG. 9. FIG. 11 is a sectional view of FIG. 8 taken along line A-A. FIG. 12 is an enlarged perspective view of a flow path shown in FIG. 8.

In the ink cartridge 11 according to the present embodiment, three ink storage chambers in which the ink I is contained are provided at the front side of the cartridge main body 10. The three ink storage chambers include the upper ink storage chamber 370 and a lower ink storage chamber 390 that are separated from each other in the vertical direction, and a buffer chamber 430 that is positioned between the upper and lower ink storage chambers.

In addition, the atmosphere communicating path 150 for allowing the atmospheric air to flow into the upper ink storage chamber 370, which is at the most upstream position, in accordance with the amount of consumption of the ink I is provided at the back side of the cartridge main body 10.

The ink storage chambers 370 and 390 and the buffer chamber 430 are sectioned from each other by the ribs 10*a*. In the present embodiment, these ink storage chambers have concavities 374, 394, and 434 formed so as to dent downward in the ribs 10*a* that extend horizontally to define the bottom walls of the storage chambers.

The concavity 374 is formed by denting a portion of the rib 10*a* that forms a bottom wall 375 of the upper ink storage chamber 370 downward. The concavity 394 is formed so as to dent in the thickness direction of the cartridge by a bottom wall 395 defined by the rib 10*a* at the bottom wall 395 of the lower ink storage chamber 390 and a swelling portion of a wall surface. The concavity 434 is formed by denting a portion of 10*a* that forms a bottom wall 435 of the buffer chamber 430 downward.

Ink outlets 371, 311, and 432 that communicate with an ink guide path 380, an upstream ink-end-sensor 400, and an ink guide path 440, respectively, are provided at or near the concavities 374, 394, and 434, respectively.

The ink outlets 371 and 432 are through holes that extend through the walls of the corresponding ink storage chambers in the thickness direction of the cartridge main body 10. The ink outlet 311 is a through hole that extends downward through the bottom wall 395.

The ink guide path 380 communicates with the ink outlet 371 of the upper ink storage chamber 370 at one end thereof and with an ink inlet 391 formed in the lower ink storage chamber 390 at the other end thereof. The ink guide path 380 guides the ink from the upper ink storage chamber 370 to the lower ink storage chamber 390.

An ink guide path 420 is connected to an ink outlet 312 provided in the cavity of the liquid remaining-amount sensor 31 disposed downstream of the lower ink storage chamber 390 at one end thereof, and to an ink inlet 431 provided in the buffer chamber 430 at the other end thereof. The ink guide path 420 guides the ink I from the lower ink storage chamber 390 to the buffer chamber 430. The guide path 420 extends obliquely upward from the ink outlet 312 formed in the cavity of the liquid remaining-amount sensor 31, and thereby provides an ascending connection between the ink storage chambers 390 and 430 so that the ink I ascends upward through the connecting flow path.

The ink guide path 440 guides the ink from the ink outlet 432 of the buffer chamber 430 to the differential pressure regulating valve 40.

According to the present embodiment, the ink inlets 391 and 431 of the ink storage chambers are respectively positioned above the ink outlets 371 and 312 formed in the corresponding storage chambers and near the bottom walls 375, 395, and 435 of the corresponding ink storage chambers.

According to the above-described structure, the three ink storage chambers 370, 390, and 430 provided in the cartridge main body 10 according to the present invention are connected to each other in series such that the ink outlet at the bottom of the concavity in the ink storage chamber at the upstream position communicates with the ink inlet provided near the bottom wall of the ink storage chamber at the downstream position.

The ink guide paths for guiding the ink from the upper ink storage chamber 370, which is a main ink storage chamber, to the ink-supplying unit 50 will be described below with reference to FIGS. 8 to 12.

The upper ink storage chamber 370 is positioned at the most upstream (uppermost) position in the cartridge main body 10, and is disposed at the front side of the cartridge main body 10, as shown in FIG. 8. The upper ink storage chamber 370 has a capacity of about half of the total capacity of the ink storage chambers, and occupies substantially an upper half section of the cartridge main body 10. The ink outlet 371 that communicates with the ink guide path 380 is formed in the concavity 374 of the bottom wall of the upper ink storage chamber 370. The ink outlet 371 is positioned below the rib 10*a* that forms the bottom wall of the upper ink storage chamber 370. Therefore, even when the ink surface in the upper ink storage chamber 370 becomes lower and reaches the bottom wall, the ink outlet 371 is still below the liquid surface and continues to stably eject the ink.

As shown in FIG. 9, the ink guide path 380 is disposed at the back side of the cartridge main body 10 and guides the ink I downward to the lower ink storage chamber 390.

The ink I contained in the upper ink storage chamber 370 is guided to the lower ink storage chamber 390. As shown in FIG. 8, the lower ink storage chamber 390 is disposed at the front side of the cartridge main body 10 and has a capacity of about half of the total capacity of the ink storage chambers. The lower ink storage chamber 390 occupies a lower half section of the cartridge main body 10. The ink inlet 391, which communicates with the ink guide path 380, is formed at a position near the rib 10*a* that forms the bottom wall of the lower ink storage chamber 390. The ink inlet 391 opens into a communicating flow path disposed under the bottom wall 395 of the lower ink storage chamber 390. The ink I from the upper ink storage chamber 370 flows into the lower ink storage chamber 390 through the communicating flow path.

The lower ink storage chamber 390 communicates with the upstream ink-end-sensor connecting flow path 400 through a through hole (not shown). The upstream ink-end-sensor connecting flow path 400 includes a maze-like flow path having a three-dimensional structure for catching the air bubbles B that flow into the maze-like flow path before the ink runs out so as to prevent the air bubbles B from flowing downstream.

The upstream ink-end-sensor connecting flow path 400 communicates with a downstream ink-end-sensor connecting flow path 410 via a through hole (not shown), and the ink I is guided to the liquid remaining-amount sensor 31 through the downstream ink-end-sensor connecting flow path 410.

The ink I guided to the liquid remaining-amount sensor 31 passes through the cavity (flow path) in the liquid remaining-amount sensor 31, and is guided to the ink guide path 420, which is disposed at the back side of the cartridge main body 10, through the ink outlet 312 formed in the cavity. The ink guide path 420 is formed so as to guide the ink I obliquely upward from the liquid remaining-amount sensor 31, and is connected to the ink inlet 431 that communicates with the buffer chamber 430. Accordingly, the ink I from the liquid remaining-amount sensor 31 is guided to the buffer chamber 430 through the ink guide path 420.

The buffer chamber 430 is a small cell defined by the ribs 10*a* at a position between the upper ink storage chamber 370 and the lower ink storage chamber 390. The buffer chamber 430 functions as a space in which the ink is stored immediately before reaching the differential pressure regulating valve 40. The buffer chamber 430 is formed so as to face the back side of the differential pressure regulating valve 40. The ink I flows into the differential pressure regulating valve 40 through the ink guide path 440 that communicates with the ink outlet 432 formed in the concavity 434 of the buffer chamber 430.

The ink I that flows into the differential pressure regulating valve 40 is guided downstream by the differential pressure regulating valve 40 to an outlet flow path 450 through a through hole 451. The outlet flow path 450 communicates with the ink-supplying unit 50. The ink I is supplied to the ink jet recording apparatus through the ink supply needle 240 inserted into the ink-supplying unit 50.

Next, the atmosphere communicating path 150 extending from the atmospheric vent 100 to the upper ink storage chamber 370 will be described below with reference to FIGS. 8 to 12.

When the ink I contained in the ink cartridge 1 is consumed and the pressure in the ink cartridge 1 is reduced, the atmospheric air (air) flows into the upper ink storage chamber 370 through the atmospheric vent 100 by an amount corresponding to the amount of reduction of the ink I.

The small hole 102 formed in the atmospheric vent 100 communicates with a meandering path 310 provided at the back side of the cartridge main body 10 at one end thereof. The meandering path 310 is formed so as to increase the distance from the atmospheric vent 100 to the upper ink storage chamber 370 and has an elongate shape so as to suppress the evaporation of moisture in the ink. The other end of the meandering path 310 is connected to the gas-liquid separation filter 70.

The gas-liquid separation chamber 70*a* included in the gas-liquid separation filter 70 has a through hole 322 in the bottom surface thereof, and communicates with a space 320 provided at the front side of the cartridge main body 10 through the through hole 322. In the gas-liquid separation filter 70, the gas-liquid separation film 71 is disposed between the through hole 322 and the other end of the meandering path 310. The gas-liquid separation film 71 is made of a mesh webbing made of a textile material having high water repellency and oil repellency.

The space 320 is provided at an upper right section of the upper ink storage chamber when viewed from the front of the cartridge main body 10. In the space 320, a through hole 321 is formed above the through hole 322. The space 320 communicates with an upper connecting flow path 330 formed at the back side through the through hole 321.

The upper connecting flow path 330 extends through a section adjacent to the top surface of the ink cartridge 1, that is, through an uppermost section in the direction of gravity when the ink cartridge 1 is in the attached state. The upper connecting flow path 330 includes flow-path portions 333 and 337. The flow-path portion 333 extends rightward from the through hole 321 along the long side when viewed from the back side. The flow-path portion 337 extends above the flow-path portion 333 from a bent portion 335 positioned near a short side to a through hole 341 formed at a position near the through hole 321. The through hole 341 communicates with an ink trap chamber 340 formed at the front side.

When the upper connecting flow path 330 is viewed from the back, the flow-path portion 337, which extends from the bent portion 335 to the through hole 341, has a position 336 at which the through hole 341 is formed and a recess 332 that is deeper than the position 336 in the cartridge thickness direction. A plurality of ribs 331 are formed so as to divide the recess 332. The flow-path portion 333 that extends from the through hole 321 to the bent portion 335 is shallower than the flow-path portion 337 that extends from the bent portion 335 to the through hole 341.

According to the present embodiment, the upper connecting flow path 330 is provided at the uppermost section in the direction of gravity. Therefore, basically, the ink I is prevented from reaching the atmospheric vent 100 through the upper connecting flow path 330. In addition, the upper connecting flow path 330 is thick enough to prevent the backflow of the ink caused by the capillary phenomenon. In addition, since the recess 332 is formed in the flow-path portion 337, the ink that flows backward can be easily caught.

The ink trap chamber 340 is a rectangular parallelepiped space formed at an upper right corner of the cartridge main body 10 when viewed from the front. As shown in FIG. 12, the through hole 341 is formed at a position near the upper left back corner of the ink trap chamber 340 when viewed from the front. In addition, a notch portion 342 is formed in the rib 10*a* that functions as a separation wall at the lower right front corner of the ink trap chamber 340. Thus, the ink trap chamber 340 communicates with a connecting buffer chamber 350 through the notch portion 342. The ink trap chamber 340 and the connecting buffer chamber 350 are air chambers obtained by partially increasing the volume of the atmosphere communicating path 150 at intermediate positions thereof. Even if the ink flows backward from the upper ink storage chamber 370 for some reason, the ink can be trapped in the ink trap chamber 340 and the connecting buffer chamber 350, so that the ink I can and be prevented from flowing further toward the atmospheric vent 100.

The connecting buffer chamber 350 is a space provided below the ink trap chamber 340. The pressure reducing hole 110 for removing the air in the process of injecting the ink is provided in a bottom surface 352 of the connecting buffer chamber 350. In addition, a through hole 351 that extends in the thickness direction is formed at a position near the bottom surface 352, that is, at a lowermost position in the direction of gravity in the state in which the ink cartridge is attached to the ink jet recording apparatus. The connecting buffer chamber 350 communicates with a connecting flow path 360 provided at the back side through the through hole 351.

The connecting flow path 360 extends upward in a central area when viewed from the back, and communicates with the upper ink storage chamber 370 through a through hole 372 that opens at a position near the bottom surface of the upper ink storage chamber 370. Accordingly, the structure from the atmospheric vent 100 to the connecting flow path 360 forms the atmosphere communicating path 150 according to the present embodiment. The connecting flow path 360 has a meniscus structure, and the thickness thereof is determined such that the ink I is prevented from flowing backward.

In the ink cartridge 1 according to the present embodiment, as shown in FIG. 8, in addition to the above-described ink storage chambers (the upper ink storage chamber 370, 390, and the buffer chamber 430), the air chambers (the ink trap chamber 340 and the connecting buffer chamber 350), and the ink guide paths (the upstream ink-end-sensor connecting flow path 400 and the downstream ink-end-sensor connecting flow path 410), an ink-free chamber 501 that is free from the ink I is also provided at the front side of the cartridge main body 10.

The ink-free chamber 501 is shown as a hatched area near the left side, and is formed between the upper ink storage chamber 370 and the lower ink storage chamber 390 at the front side of the cartridge main body 10.

The ink-free chamber 501 has an atmospheric vent 502 that extends through a back wall thereof at an upper left corner of the inner space, and communicates with the atmosphere through the atmospheric vent 502.

The ink-free chamber 501 functions as a deaerating chamber that accumulates negative deaeration pressure in the process of vacuum-packaging the ink cartridge 1.

The above-described ink cartridge 1 includes the three ink storage chambers 370, 390, and 430. In the ink storage chambers 370, 390, and 430, the ink is collected at the concavities 374, 394, and 434, respectively, which are relatively small compared to the area of the bottom walls of the ink storage chambers 370, 390, and 430, and is guided to the ink guide paths through the ink outlets 371, 311, and 432 formed at the bottom of the concavities 374, 394, and 434, respectively.

More specifically, even when the amount of ink remaining in the ink storage chambers is reduced, the ink remaining in the ink storage chambers is collected at the small concavities 374, 394, and 434, so that the distances from the ink outlets 371, 311, and 432 to the liquid surface are maintained large. Therefore, unlike the known structure in which the bottom wall of each ink storage chamber is free from the concavity and the ink outlet is formed directly in the broad bottom wall, the fluidity of the ink I toward the in outlets 371, 311, and 432 is not reduced in the ink storage chambers 370, 390, and 430.

Therefore, even when the amount of ink I remaining in the ink storage chambers 370, 390, and 430 is reduced, the ink I is connected at the concavities 374, 394, and 434 first, and is then smoothly and quickly guided to the ink guide paths. Therefore, the failure that the air layers come into contact with the ink outlets 371, 311, and 432 in the ink storage chambers 370, 390, and 430, respectively, and the air bubbles B are sucked into the ink guide paths even though the ink I still remains in the ink storage chambers 370, 390, and 430 can be prevented.

As a result, the liquid remaining-amount sensor 31 is prevented from making a false detection that the ink I has run out due to the air bubbles B sucked into the ink guide paths even though the ink I still remains in the ink storage chambers. Thus, the amount of ink remaining in the link storage chambers 370, 390, and 430 that is discarded without being used can be considerably reduced.

In addition, when the air bubbles flow out of the ink outlet 311, there is no ink I remaining in the ink storage chamber 390. Therefore, there is no possibility that the ink I remaining in the ink storage chamber 390 will move toward the ink outlet 311 and flow out of the ink outlet 311. Accordingly, the liquid remaining-amount sensor is prevented from detecting the presence of ink after detecting the absence thereof. Thus, the reliability of the liquid remaining-amount sensor can be increased.

In addition, in the above-described embodiment, the ink cartridge 1 includes a plurality of ink storage chambers 370, 390, and 430. Therefore, the amount of liquid that can be contained is increased and the ink storage capacity of the ink cartridge can be increased accordingly.

In addition, the effect of suppressing the air bubbles from flowing out can be provided in multiple stages by the concavities 374, 394, and 434 formed in the ink storage chambers 370, 390, and 430.

Therefore, an increase in the ink storage capacity and a reduction in the amount of ink that remains in the ink storage chambers without being used and that is discarded can both be achieved.

In addition, the ink inlet 391 of the ink storage chamber 390 at the downstream position is positioned near the bottom wall of the ink storage chamber 390. Therefore, when the ink I contained in the ink storage chamber 370 at the upstream position is completely consumed and the ink I contained in the ink storage chamber 390 at the downstream position is partially consumed, the ink guide path 380 connecting the ink storage chamber 370 and the ink storage chamber 390 forms a meniscus. Since the air that enters the ink storage chamber 390 is prevented from communicating with the atmosphere due to the meniscus, natural ventilation does not occur. Therefore, the ink I remaining in the ink storage chamber 390 can be prevented from being evaporated.

In addition, ink-collecting ribs 600 and 601 for collecting the ink I with capillary force are provide at positions near the liquid outlets 371 and 394. Therefore, when the ink I stored in the ink storage chambers 370 and 390 is almost completely consumed, the ink I remaining in the ink storage chambers 370 and 390 is collected at the ink outlets 371 and 394 not only by the gravitational force but also by the capillary force.

Therefore, an increase in the ink storage capacity and a reduction in the amount of ink that remains in the ink storage chambers without being used and that is discarded can both be achieved. In addition, a high-reliability liquid remaining-amount sensor can be obtained.

According to the present embodiment, the ink-collecting ribs 600 and 601 are provided as the structure for collecting the ink I by the capillary force. However, a similar effect can also be obtained by forming grooves in the bottom surface of the ink storage chambers 370 and 390.

The ink cartridge 1 includes the ink storage chambers 370 and 390. The ink storage chamber 370 at the upstream position is positioned above the ink storage chamber 390 at the downstream position in the direction of gravity. Therefore, even if the ink I contained in the ink storage chambers 370 at the upstream position runs out so that air enters the ink guide path 380 and then the ink I remaining in the ink storage chamber 370 flows into the ink guide path 380 again, the ink I that flows into the ink guide path 380 later joins the ink I contained in the ink storage chamber 390 at the downstream position and be used without a problem.

In addition, the ink storage chamber 370 and the ink storage chamber 390 are connected to each other by the ink guide path 380 through which the ink I flows downward in the direction of gravity.

Therefore, all of the ink in the ink guide path 380 can be used. In addition, a high-reliability liquid remaining-amount sensor can be obtained.

In addition, in the ink cartridge 1 according to the present embodiment, the ink-free chamber 501 provided in the cartridge main body 10 functions as a deaerating chamber that accumulates negative deaeration pressure in the process of vacuum-packaging the ink cartridge 1. Therefore, even when small air bubbles remain in the cavity of the liquid remaining-amount sensor 31 after the ink injection process performed in the manufacturing factory or the like, the remaining air bubbles can be dissolved and eliminated by the negative deaeration pressure applied in the process of vacuum-packaging the ink cartridge 1. In addition, the negative deaeration pressure accumulated in the ink-free chamber 501 serves to maintain an adequate deaerated state of the vacuum package until the vacuum package is opened. Thus, an adequate storage state in which the air bubbles in the cavity of the liquid remaining-amount sensor 31 are dissolved and eliminated can be maintained.

In addition, in the ink cartridge 1 according to the present embodiment, the atmosphere communicating path 150 guides the atmospheric air into the upper ink storage chamber 370 from the outside as the ink is consumed. The atmosphere communicating path 150 is provided with the ink trap chamber 340 and the connecting buffer chamber 350 that function as air chambers and that are obtained by partially increasing the volume of the atmosphere communicating path 150 at intermediate positions thereof. Therefore, if the ink stored in the ink storage chamber 370 flows backward through the atmosphere communicating path 150 due to thermal expansion, external vibration, etc., while the ink cartridge 1 is being used, the ink trap chamber 340 and the connecting buffer chamber 350, which are air chambers provided at the intermediate positions of the atmosphere communicating path 150, function as trap spaces for catching the ink I. Therefore, the ink I can be prevented from leaking out.

In addition, the ink cartridge 1 according to the present embodiment includes the sealing film 90 that functions as blocking means. When the ink cartridge 1 is in the vacuum packed state, the sealing film 90 blocks the atmosphere communicating path 150 at a position upstream of the ink trap chamber 340 and the connecting buffer chamber 350.

Therefore, even when vibration or temperature variation is applied during transportation, the ink I contained in the ink storage chambers does not easily flow into the atmosphere communicating path 150 or into the air chambers, i.e., the ink trap chamber 340 and the connecting buffer chamber 350. Accordingly, air bubbles are prevented from being generated in the ink storage chambers or ink guide paths due to the flow of the contained ink I.

In the above-described embodiment, three ink storage chambers are provided in a single cartridge main body. However, the number of ink storage chambers to be provided in the cartridge main body is not limited to that described in the embodiment. The number of ink storage chambers provided in the cartridge main body may be single or multiple.

The application of the liquid storage container according to the present invention is not limited to the ink cartridge explained in the above-described embodiment. In addition, the liquid-consuming apparatus having a container-receiving unit to which the liquid storage container according to the present invention is attached is also not limited to the ink jet recording apparatus explained in the above-described embodiment.

The liquid-consuming apparatus may be any kind of apparatus which includes a container-receiving unit for receiving the liquid storage container in a detachable manner and to which the liquid contained in the liquid storage container is supplied. For example, the present invention may be applied to an apparatus including a color-material ejecting head used for manufacturing a color filter of a liquid crystal display or the like, an apparatus including an electrode-material (conductive paste) ejecting head used for forming electrodes of an organic EL display, a field emitting display (FED), etc., an apparatus including a living-organic-material ejecting head used for manufacturing biochips, an apparatus including a sample-ejecting head that functions as a precision pipette, etc.

What is claimed is:

1. A liquid storage container adapted to be attached to a liquid-consuming apparatus, the liquid storage container comprising:

at least one liquid storage chamber that stores liquid therein;

a liquid-supplying hole configured to be connected to an ink supply needle of the liquid-consuming apparatus;

at least one liquid guide path configured to guide the liquid stored in the liquid storage chamber to the liquid-supplying hole;

an atmosphere communicating path configured to allow atmospheric air to flow into the liquid storage chamber from the outside as the liquid in the liquid storage chamber is consumed; and a liquid remaining-amount sensor disposed at an intermediate position of the liquid guide path and determining that the liquid in the at least one liquid storage chamber has run out when a flow of gas into the liquid guide path is detected, wherein the at least one liquid storage chamber has a bottom wall having a concavity, and a liquid outlet that communicates with the liquid guide path is provided at the bottom of the concavity, and wherein the at least one liquid guide path and the liquid remaining-amount sensor are provided downstream of the liquid outlet of the at least one liquid storage chamber and upstream of the liquid-supplying hole.

2. The liquid storage container according to claim 1, wherein the at least one liquid storage chamber includes a plurality of liquid storage chambers, the plurality of liquid storage chambers being connected to each other in series such that the liquid outlet at the bottom of the concavity of one of the storage chambers that is disposed at an upstream position communicates with a liquid inlet provided near the bottom wall of another one of the storage chambers that is disposed at a downstream position.

3. The liquid storage container according to claim 1, further comprising a rib or a groove for collecting the liquid contained in the liquid storage chamber by a capillary force, the rib or the groove being disposed near the liquid outlet of the liquid storage chamber.

4. The liquid storage container according to claim 1, wherein the at least one liquid storage chamber includes two or more liquid storage chambers, wherein one of the storage chambers that is disposed at an upstream position is at an upper position in the direction of gravity and another one of the storage chambers that is disposed at a downstream position is at a lower position in the direction of gravity, and wherein the storage chambers are connected to each other in series by a connecting flow path, the liquid flowing downward in the direction of gravity in the connecting flow path.

5. A liquid storage container adapted to be attached to a liquid-consuming apparatus, the liquid storage container comprising:

at least one liquid storage chamber that stores liquid therein;

a liquid-supplying hole configured to be connected to an ink supply needle of the liquid-consuming apparatus;

at least one liquid guide path configured to guide the liquid stored in the liquid storage chamber to the liquid-supplying hole;

an atmosphere communicating path configured to allow atmospheric air to flow into the liquid storage chamber from the outside as the liquid in the liquid storage chamber is consumed; and a liquid sensor disposed in the liquid guide path, wherein the liquid storage chamber has a bottom wall having a concavity, and a liquid outlet that communicates with the liquid guide path is provided at the bottom of the concavity, and wherein the at least one liquid guide path and the liquid sensor are provided downstream of the liquid outlet of the at least one liquid storage chamber and upstream of the liquid-supplying hole.

6. The liquid storage container according to claim 2, wherein the plurality of liquid storage chambers include first and second liquid storage chambers disposed at upstream of the liquid remaining-amount sensor and a third liquid storage chamber disposed at downstream of the liquid remaining-amount sensor.

7. A liquid storage container adapted to be attached to a liquid-consuming apparatus, the liquid storage container comprising:

liquid storage chambers storing liquid therein;

a liquid-supplying unit configured to be connected to an ink supply needle of the liquid-consuming apparatus;

liquid guide paths configured to guide the liquid stored in the liquid storage chambers to the liquid-supplying unit;

an atmosphere communicating path configured to allow atmospheric air to flow into one of the liquid storage chambers from the outside as the liquid in the liquid storage chambers is consumed; and a liquid sensor disposed at an intermediate position of one of the liquid guide paths, wherein the liquid storage chambers include first and second liquid storage chambers disposed at upstream of the liquid sensor and a third liquid storage chamber disposed at downstream of the liquid sensor, wherein each one of the liquid storage chambers has a bottom wall having a concavity, and a liquid outlet that communicates with corresponding one of the liquid guide paths is provided at the bottom of the concavity, and wherein the liquid storage chambers are connected to each other in series such that the liquid outlet of one of the liquid storage chambers that is disposed at an upstream position communicates with a liquid inlet provided near the bottom wall of another one of the liquid storage chambers that is disposed at a downstream position;

wherein the liquid guide paths and the liquid sensor are provided downstream of the liquid outlet of the one of the liquid storage chambers and upstream of the liquid-supplying unit.

8. The liquid storage container according to claim 1, wherein the concavity is formed as a dent downwards in the bottom wall.

9. The liquid storage container according to claim 5, wherein the concavity is formed as a dent downwards in the bottom wall.

10. The liquid storage container according to claim 7, wherein the concavity is formed as a dent downwards in the bottom wall.

11. The liquid storage container according to claim 8, wherein the bottom wall is formed by a horizontal rib and the concavity is formed as the dent downwards in the rib.

12. The liquid storage container according to claim 9, wherein the bottom wall is formed by a horizontal rib and the concavity is formed as the dent downwards in the rib.

13. The liquid storage container according to claim 10, wherein the bottom wall is formed by a horizontal rib and the concavity is formed as the dent downwards in the rib.

14. The liquid storage container according to claim 1, further comprising a buffer chamber provided in the liquid guide path downstream of the liquid sensor, the buffer chamber being a space in which the ink is stored before reaching a differential pressure regulating valve.

15. The liquid storage container according to claim 5, further comprising a buffer chamber provided in the liquid guide path downstream of the liquid sensor, the buffer chamber being a space in which the ink is stored before reaching a differential pressure regulating valve.

16. The liquid storage container according to claim 7, further comprising a buffer chamber provided in the liquid guide path downstream of the liquid sensor, the buffer chamber being a space in which the ink is stored before reaching a differential pressure regulating valve.

* * * * *